US006915921B2

(12) United States Patent
Mensch

(10) Patent No.: US 6,915,921 B2
(45) Date of Patent: Jul. 12, 2005

(54) DUSTPAN/TRASH CAN

(76) Inventor: George Mensch, 2460 N. Providence Rd., Media, PA (US) 19063

( * ) Notice: Subject to any disclaimer, the term of this patent is extended or adjusted under 35 U.S.C. 154(b) by 0 days.

(21) Appl. No.: 10/329,840

(22) Filed: Dec. 26, 2002

(65) Prior Publication Data

US 2004/0124195 A1 Jul. 1, 2004

(51) Int. Cl.[7] ..... A47L 13/52; B65D 25/30; B65D 43/08; B65D 51/24

(52) U.S. Cl. ..... 220/212; 15/257.5; 220/212.5; 220/908; 220/908.3; D32/74

(58) Field of Search ..... 220/212, 212.5, 220/908, 908.3; 15/104.8, 257.1, 257.5, 257.6, 257.8; D32/74

(56) References Cited

U.S. PATENT DOCUMENTS 3,156,941 A * 11/1964 Tomaiuolo ..... 15/257.1
3,390,804 A * 7/1968 Morgan ..... 220/212
4,600,113 A * 7/1986 DeMars ..... 220/212
4,795,046 A * 1/1989 Rath ..... 220/694
4,802,258 A * 2/1989 Jensen ..... 15/257.1
4,907,710 A * 3/1990 Bulkens ..... 220/495.1
D308,273 S * 5/1990 Hanna ..... D34/11
5,172,823 A * 12/1992 Moetteli ..... 220/212
5,407,089 A * 4/1995 Bird et al. ..... 220/212.5
5,611,450 A * 3/1997 DeMars ..... 220/212
5,661,868 A * 9/1997 Panagakos et al. ..... 15/184
6,120,743 A * 9/2000 Papari ..... 422/300
6,234,549 B1 * 5/2001 Brownell ..... 294/1.3

* cited by examiner

*Primary Examiner*—Lee Young
*Assistant Examiner*—Niki M. Eloshway
(74) *Attorney, Agent, or Firm*—Eugene E. Renz, Jr.

(57) ABSTRACT

A lid for a dustpan/trash can comprising a generally circular top having a downwardly depending, circumferentially extending lip projecting from the outer periphery of said top, a trough like member attached to the lip of the top including a planar base positioning the top generally perpendicular to a surface on which the base is placed, said trough section having an upwardly inclined ramp, an elongated straight edge so that waste material may be scooped into the trough.

2 Claims, 5 Drawing Sheets

DUSTPAN/TRASH CAN

FIELD OF THE INVENTION

The present invention relates to improvements in trash cans and more specifically to a novel improvement facilitating use of the lid of the trash can in the manner of a dustpan collector.

BACKGROUND OF THE INVENTION

Trash cans typically comprise an elongated generally cylindrical hollow container closed at one axial end and a lid which snap fastens to the upper end of the container. Typically, the lid has diametrically opposed handles which engage and lock with a peripheral, circumferentially extending outwardly directed flange on the top edge of the container to secure the trash placed in the container.

Dust pans are well known and typically comprise a generally a rectangular tray having a handle and an elongated flat edge to be placed flush on a support surface such as flooring so that the user can sweep accumulated dust and dirt particles into the dust pan.

SUMMARY OF THE INVENTION

The present invention is a combination trash can and dustpan which has an interesting and unique feature including a funnel-like attachment to a portion of the rim of the lid configured to provide an elongated generally flat edge which can be placed on a supporting surface such as the ground or a floor and steadied in place by a foot-hold arrangement to facilitate picking up extraneous trash particles and the like and dumping them in the trash can.

Accordingly with the above in mind, it is an object to the present invention to provide a combined trash can and dustpan assembly which retains the normal function of a trash container and lid and wherein the lid can also be utilized as a dustpan for pick up and dispose of extraneous waste particular material.

Another object of the present invention is to provide an assembly of the above type which is easy and economical to manufacture and fully effective for the purposes intended.

BRIEF DESCRIPTION OF THE DRAWINGS

These and other objects of the present invention the various features in details of the operation and construction of a combination trash can and trash can/dustpan in accordance with the present invention are here and after marked fully set forth with reference to the accompanying drawings, wherein.

DESCRIPTION OF THE PREFERRED EMBODIMENT

Figure 1:
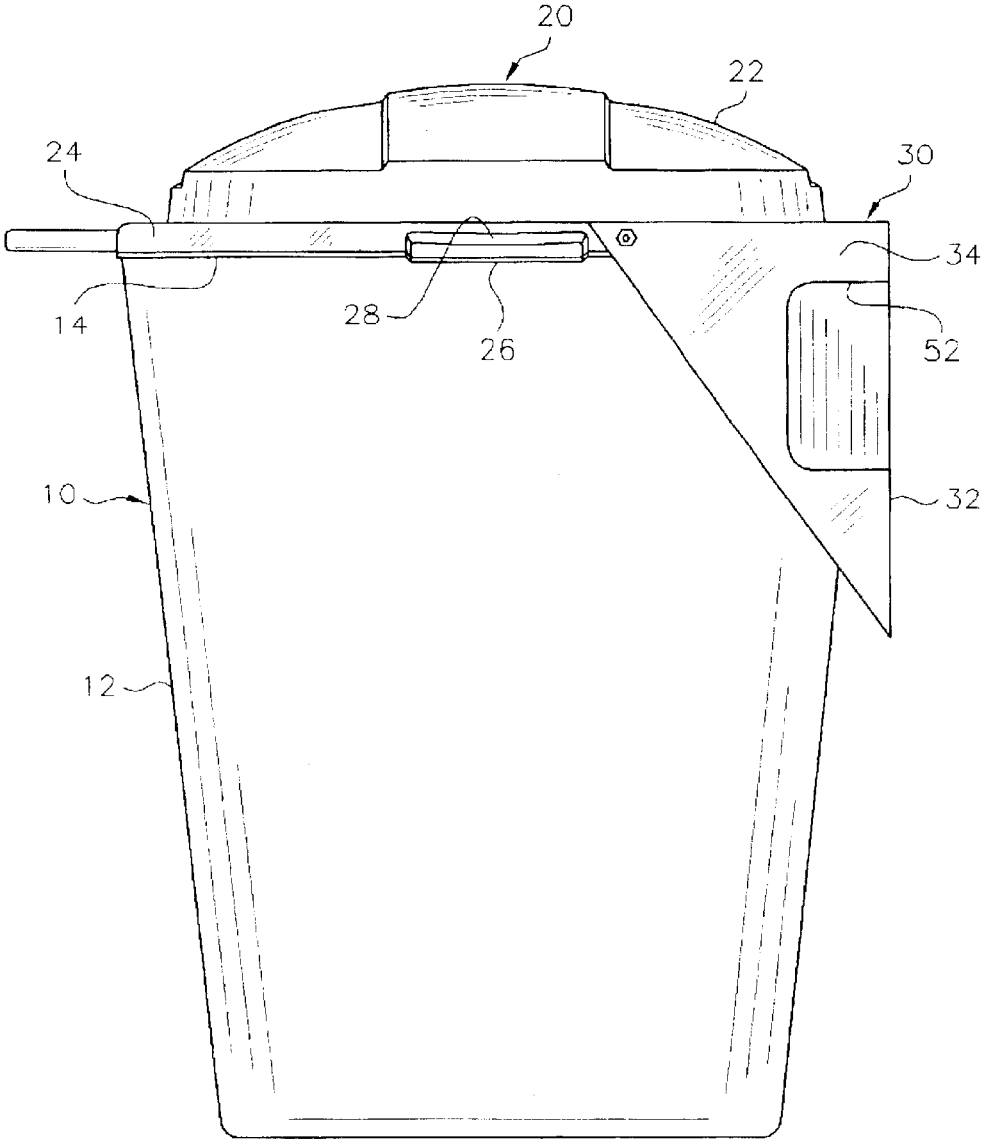
FIG. 1 is a side elevational view of the dustpan/trash can assembly in accordance with the present invention.

Referring now to the drawings, there is shown a preferred embodiment of the present invention. As illustrated therein, the trash can or container (10) has elongated slightly tapered body portion (12) having a circumferentially extending radially outwardly directed flange or bead (14) at its upper end.

The lid generally designated by the numeral 20 comprises a dome-like generally circular top (22) having a downwardly depending circumferentially extending lip (24) of a diameter to fit over the bead (14) on the container when the lid is in place to close the container. The lid has diametrically opposed, radially outwardly extending projections (26) which snap-fit with the bead (14) of the container to lock the lid in place. The snap-fit arrangement is of conventional design and also provides handles (28) to apply and remove the lid (20) from the container (10).

Figure 2:
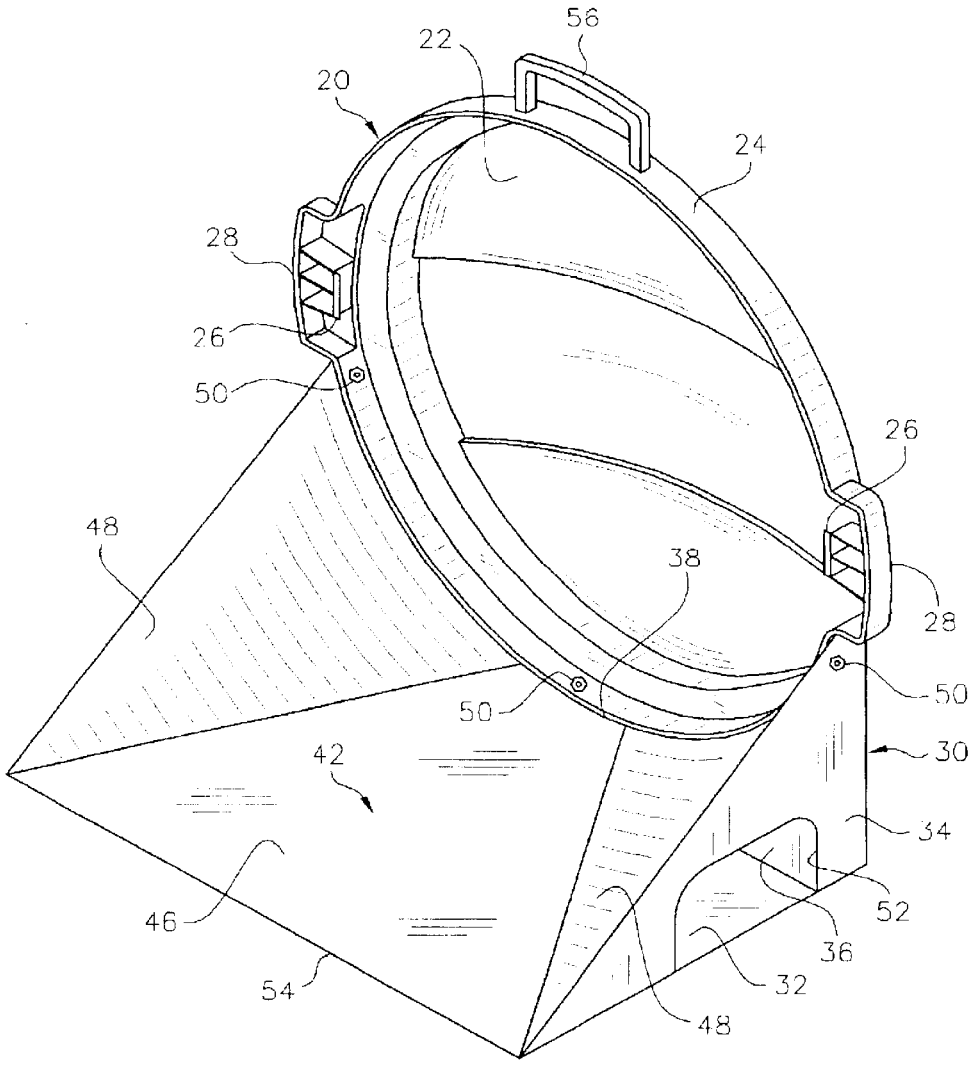
FIG. 2 is a perspective view of the lid assembly showing the details of the invention.

In accordance with the present invention, the lid (20) is modified in a manner to be in part a dustpan assembly suitable for collection of waste materials. As illustrated, the dustpan adaptor generally designated by numeral (30) comprises a generally square planar base portion (32) having spaced upstanding sidewalls (34) of generally triangular shape connected by a back panel (36) having an arcuate cutout (38) generally conforming to the semicircular shape of the lip (24) of the lid (20). The cutout (38) extends approximately the distance between the two handles (28) on the rim (24) of the lid (20) in the manner shown in FIG. 2.

The collector portion (42) of the adaptor comprises a generally trapezoidal planar center section (46) and two side panels (48) which have a funnel arcuate shape. The adaptor is connected to the rim of the lid (20) by suitable fasteners (50). It is noted that the lid and adaptor may be molded as a one-piece assembly.

Figure 3:
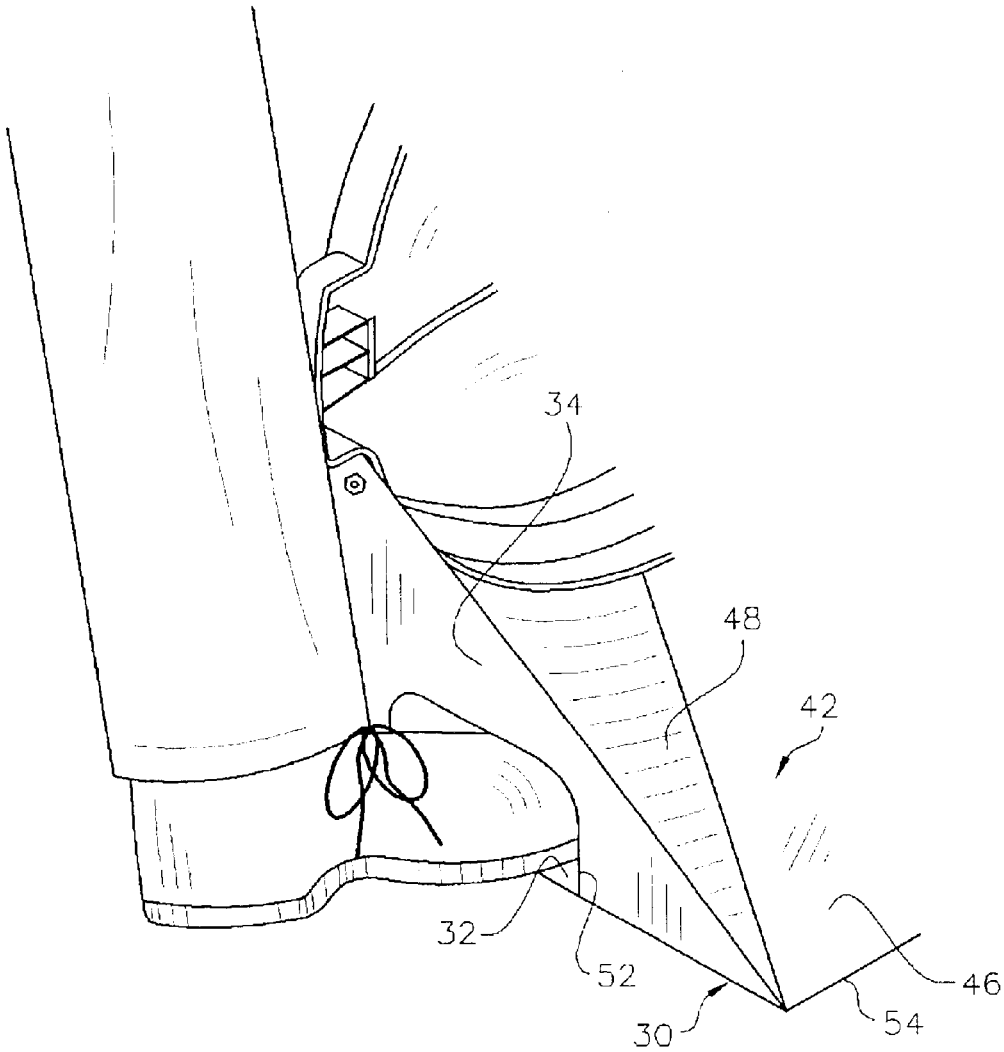
FIG. 3 is a fragmentary view showing the foot-hold arrangement for steadying the lid while the user manipulates a broom to sweep and accumulate, in this case, leaves in the manner shown in FIG. 4.
Figure 4:
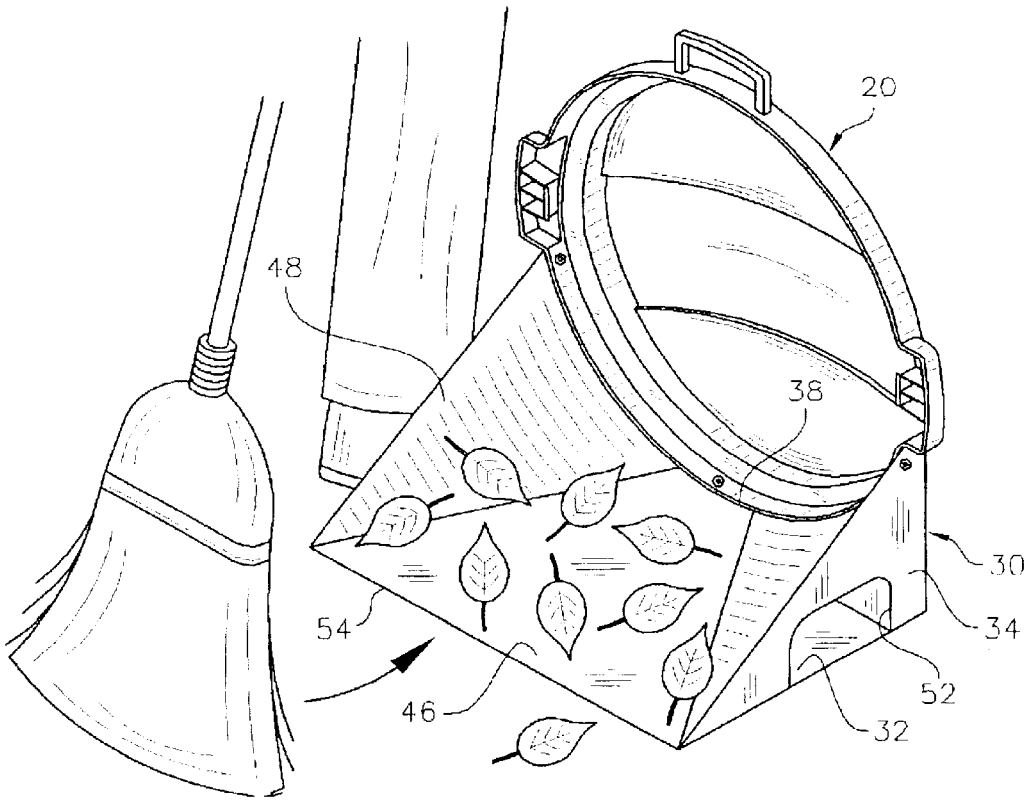
FIG. 4 is a perspective view showing the trash can lid in use as a collector.

The side panels (34) have cutouts (52) of a size to allow a user's foot to be inserted there through to press the base (32) against a supporting surface and steady the assembly when it is being used in the manner shown in FIGS. 3 and 4.

Figure 5:
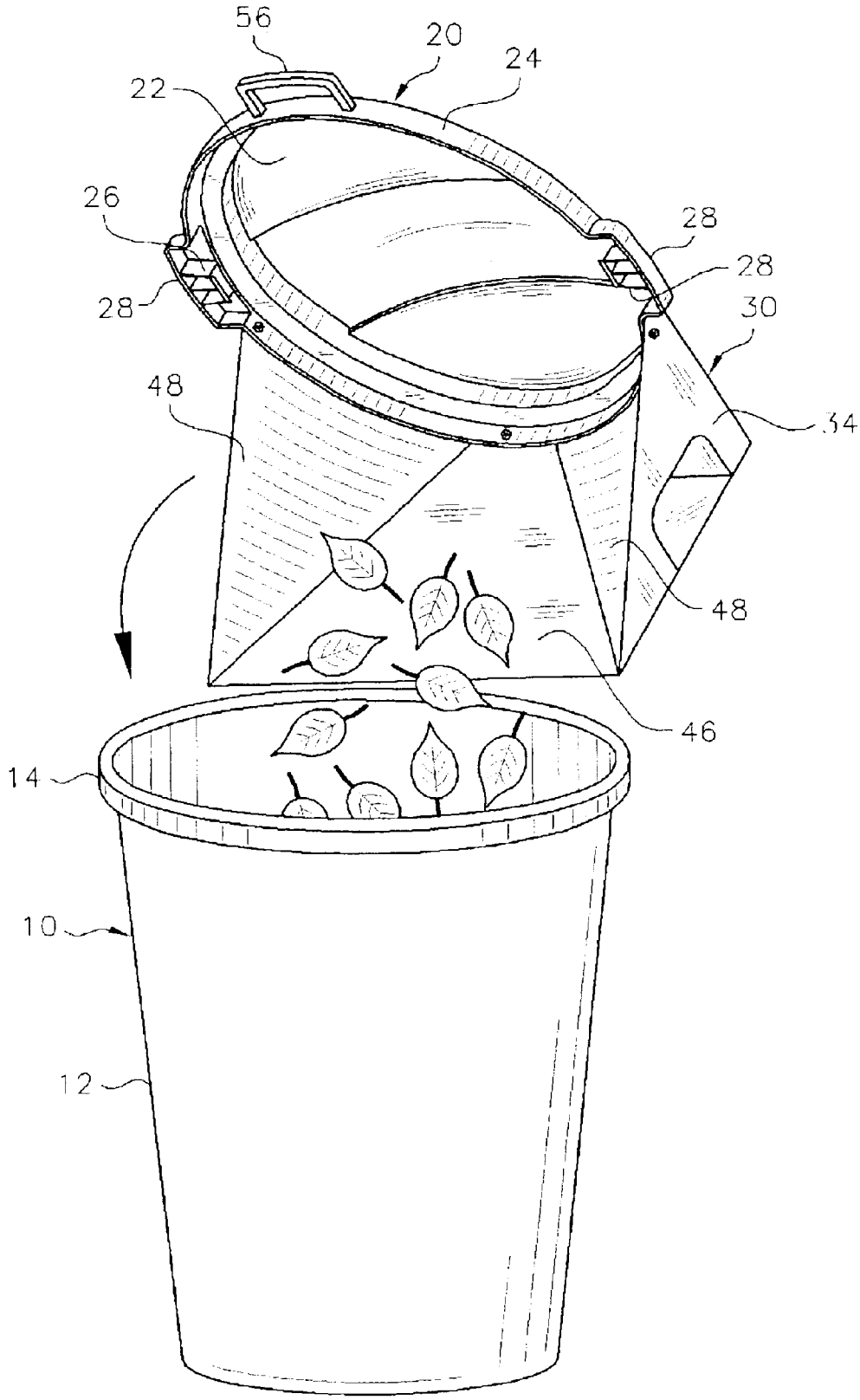
FIG. 5 is a view showing the emptying of the lid into the trash can.

The trapezoidal front panel (46) as illustrated has an elongated front edge (54) and is upwardly inclined relative to the base (32) so that particulate waste material can be easily swept into the funnel-shaped troth. The interior of the lid (20) defines an enclosure area or backstop to contain particulate or other matter being collected (see FIGS.). A handle (56) may be provided on the lid so that a user can grasp the lid and adaptor to discharge waste material into the trash container in the manner shown in FIG. 5.

Consider now use of the trash can/dustpan the present invention. In normal use, the lid (20) is secured over the container (10) in the manner shown in FIG. 1 and does not interfere with normal opening and closing of the lid (20) when needed or desired. When used as a collector for particulate materials, the base (32) is simply positioned on a flat surface, the user steadies and secures the assembly by simply inserting his foot through the openings 52 in the end panels. The foot feature permits the user to apply both hands to the broom. User can use a broom to accumulate particulate matter and grasps the handle (56) to empty the pan when needed.

Even though a particulate embodiment of the invention has been illustrated and described herein, changes and modifications may be made therein within the scope of the following claims.

What is claimed is:

1. A lid for a dustpan/trash can comprising a generally circular top having a downwardly depending, circumferentially extending lip projecting from the outer periphery of sold top, a trough like member attached to the lip of the top including a planar base positioning the top generally perpendicular to a surface on which the base is placed, and spaced side walls extending upwardly from the base and generally perpendicular thereto, said trough like member trough having an upwardly inclined ramp and an elongated straight edge so that waste material may be scooped into the trough and means defining an opening in the side walls of a size and shape to allow entry of a user's foot to press the base against a supporting surface and steady the lid during use.

2. A lid claimed in claim 1 wherein said side walls are of generally triangular shape and are connected by a back panel having an arcuate cutout generally conforming to the semicircular shape of the lid which extends approximately the distance between two handles on the lip of the top and wherein said upwardly inclined ramp has a generally trapezoidal planar center section and two outrigger panels which have a funnel-like arcuate shape.

* * * * *